US005498107A

United States Patent [19]

Schatzle, Jr.

[11] Patent Number: 5,498,107

[45] Date of Patent: Mar. 12, 1996

[54] APPARATUS AND METHOD FOR INSTALLING CABLED GUYED CAISSONS

[76] Inventor: Conrad J. Schatzle, Jr., Rte. 3, Box 70, Hidden Hills Lake, Arnaudville, La. 70512

[21] Appl. No.: 342,910

[22] Filed: Nov. 21, 1994

[51] Int. Cl.[6] ..... E02B 17/00

[52] U.S. Cl. ..... 405/224; 405/195.1

[58] Field of Search ..... 405/169, 195.1, 405/211, 212, 224; 166/359, 369

[56] References Cited

U.S. PATENT DOCUMENTS

| | | | |
|---|---|---|---|
| 3,701,261 | 10/1972 | Nolan, Jr. | 405/169 |
| 4,640,647 | 2/1987 | Blair et al. . | |
| 4,710,061 | 12/1987 | Blair et al. . | |
| 4,818,146 | 4/1989 | Fontenot . | |
| 4,932,811 | 6/1990 | Folding | 405/227 |
| 4,983,074 | 1/1991 | Carruba | 405/224 X |
| 5,094,567 | 3/1992 | Nista et al. | 405/224 X |

OTHER PUBLICATIONS

Oil & Gas Journal, Ad p. 7, for Tarpon Systems, Inc. dated Mar. 6, 1995.

*Primary Examiner*—William P. Neuder

*Attorney, Agent, or Firm*—William W. Stagg

[57] ABSTRACT

An apparatus and method for supporting the conductor pipe, the access platforms, the wellhead and the wellhead equipment of an offshore well located in a depth of water above a water bottom after a drilling rig has been removed from the location, where a movable drilling rig is used to drive the conductor pipe into the mudline of the water bottom and temporarily support the conductor pipe while the offshore well is drilled and completed with a wellhead, through the conductor pipe, comprising means for holding the conductor pipe in tension from the drilling rig; a caisson driven into the mudline adjacent to the conductor pipe; a plurality of at least three anchor piles driven into the mudline around the caisson; a plurality of anchor cables; means for attaching to the anchor piles and to the caisson; means for tightening the cables to a desired degree of tension; a plurality of conductor braces mounted to the caisson between the caisson and the conductor pipe for supporting the conductor pipe at intervals along its length above the mudline; and wellhead access means mounted to the caisson for access to the wellhead.

26 Claims, 16 Drawing Sheets

APPARATUS AND METHOD FOR INSTALLING CABLED GUYED CAISSONS

FIELD OF INVENTION

The present invention generally relates to the field of installing offshore structures for the production of hydrocarbons, and more particularly, relates to a method for supporting a well conductor pipe by means of an adjacent cable guyed caisson installed from the drilling rig with the assistance of a dive boat and crew.

BACKGROUND OF INVENTION

In the field of offshore oil and gas exploration, in the early stages of developing a particular area or field, it is often necessary to first drill and complete test wells to determine the viability of continued exploration and drilling in that area. When conventional multi-legged fixed offshore platforms are installed during these early stages, the cost of the initial drilling and testing is greatly increased. This high initial cost reduces the incentive to speculate on drilling in untested locations and thus impedes the search for new oil and gas fields.

Efforts to reduce the cost of drilling and testing these initial exploration wells at unproven drilling locations have included supporting wellhead platforms from a single conductor pipe or main casing. This eliminates the necessity of having conventional platform installed from the onset of the drilling project. In the typical conductor supported installation, the main casing or conductor pipe supports a boat landing, ladders and a small platform to provide access to the wellhead. In shallow water, the main casing is mudline supported and must be sized to have sufficient structural integrity to be free standing above the mudline. In deeper water, the supporting of the main casing from the mudline becomes impractical and the main casing is supported by a system of cables attached to anchor piles driven into the water bottom around its periphery, much like a guyed tower or flag pole.

One method and apparatus for cable guyed offshore structures is described in U.S. Pat. No. 4,818,146 to Ozeman J. Fontenot. In Fontenot, the conductor pile is driven to refusal in the mudline below a body of water. An annular brace with an upper collar portion for attaching the ends of a plurality of support cables and a lower collar portion with a plurality of pulleys corresponding to the number of support cables being utilized is attached to the conductor pile. During installation one end of each cable is attached to an anchor pile. Each anchor pile is then releasably attached to a drive pile and anchor pile combination is driven by means of a hammer located and operated from a derrick barge above the water surface. When the anchor pile is driven to a satisfactory depth below the mudline beneath the water surface, the drive pile is released from the anchor pile and removed. The free end of each cable is then journalled around one of the pulleys on the lower collar portion of the brace, attached to the upper collar portion, and the cable is tightened by sliding the lower collar portion down the conductor pipe.

Another apparatus and method for installation of a cable supported main casing is described in U.S. Pat. Nos. 4,640,647 and 4,710,061 to Christon R. Blair and Kenneth B. Parker. The Blair et al patents disclose a method similar to that of Fontenot in that there is attached to the conductor pile longitudinally positionable clamping means having a plurality of pulleys for receiving the cables. When installing the Blair et al apparatus, anchor piles with an attached cable are driven with releasable drive piles in a method similar to that described in Fontenot. The free end of each cable is then positioned through its respective pulley on the clamping means, pulled tight and attached to the clamping means to provide support to the main conductor, also in a manner similar to that of Fontenot.

There are certain disadvantages to the methods and apparatus described by Fontenot and by Blair et al. First, the method of installing the anchor piles with the releasable drive piles at the desired distance and location around the caisson typically requires the use, and therefore the cost, of a derrick barge or other vessel from which to position the anchor pile and operate the pile driving hammer. This is in addition to the need for a drilling rig and dive boat to complete the other phases of installation.

Second, the use of pulleys positioned on the collar clamp to place tension on the cables to support the caisson has disadvantages. The pulleys are subject to corrosion due to the salt water environment which can reduce their effectiveness. The cables and the pulleys are also subject to metal fatigue at each cable-pulley interface from the repetitive stresses induced in the cable due to the wind, wave and tide actions found in offshore locations. This fatigue increases the chance of materials failure and results in the need for frequent inspection and maintenance of the pulleys, cables and clamps.

An additional disadvantage of both Fontenot and Blair et al is that the main conductor pipe must have a sufficient overall diameter and thickness to provide structural support for the ladders, the boat landing, the access platforms and the wellhead, even when the cables and anchor piles are in place to support the main conductor pipe. This necessarily requires the drilling contractor to use larger conductor pipe than that which might be required simply to serve as a conductor for the drilling and production tubing. The higher cost of the larger sized conductor pipe is reflected in the cost of drilling and testing the exploration wells.

Consequently, a need exist for improvements in the design and installation of cabled guyed offshore structures to decrease the cost of drilling and testing exploration wells at offshore locations.

SUMMARY OF INVENTION

The present invention provides an apparatus and method designed to satisfy the aforementioned needs. It describes a method of installing a cable guyed caisson adjacent to a nominally sized conductor pipe. This cable guyed caisson is then fitted with conductor support braces to support the conductor pipe. The caisson also serves as the main support for the other structural features, such as the platform required to provide access to the wellhead.

The method of the present invention eliminates the need to use drive piling during the installation of the cable anchor piling. The method of the present invention also eliminates the use of pulleys to tension the support cables and thus the fatigue and corrosion problems associated with such pulleys. In addition, the apparatus and method provides a means to expand the wellhead by utilizing as a structural feature conductor guides incorporated in the conductor support braces attached along the length of the guyed caisson. These conductor guides facilitate the installation of and provide support to additional conductor pipes to be used in drilling multiple wells once the caisson structure is in place.

Accordingly, the present invention relates to an apparatus and method for installing an offshore cable guyed caisson adjacent to a nominally sized conductor pipe for supporting the conductor pipe, the wellhead platform and its attendant structures where the cable anchor piles are installed without the use of drive piling and where the cables are attached to the caisson and tensioned without the use of pulleys. The invention contemplates using an offshore drilling rig to drive a nominally sized conductor pipe, holding the conductor pipe in tension from the drilling rig, drilling through the conductor pipe to complete a well, and also includes the steps of floating a support caisson to the well site, driving the caisson from the caisson drilling rig adjacent to the conductor pipe while maintaining the conductor pipe in tension, attaching cables to the caisson and the anchor piles, installing anchor piling around the periphery of the caisson, tightening the cables between the caisson and the anchor piles by means of hydraulic jacks, and installing conductor support braces between the caisson and the conductor pipe below the water surface along the length of the caisson. The method of the present invention also includes the step of incorporating conductor pile guides along the caisson as part of the conductor support structure so that multiple conductor pipes and wellheads may be supported from the same structure.

At the typical offshore well location, a drilling rig is positioned as desired. The conductor pipe is then driven into the mudline below the water surface and supported in tension from the drilling rig while the well is being drilled through the conductor pipe. After it is determined that the well is producing sufficient hydrocarbons to warrant a support structure, the method and apparatus of the present invention may be utilized.

DESCRIPTION OF THE PREFERRED EMBODIMENT

Figures 1, 2:
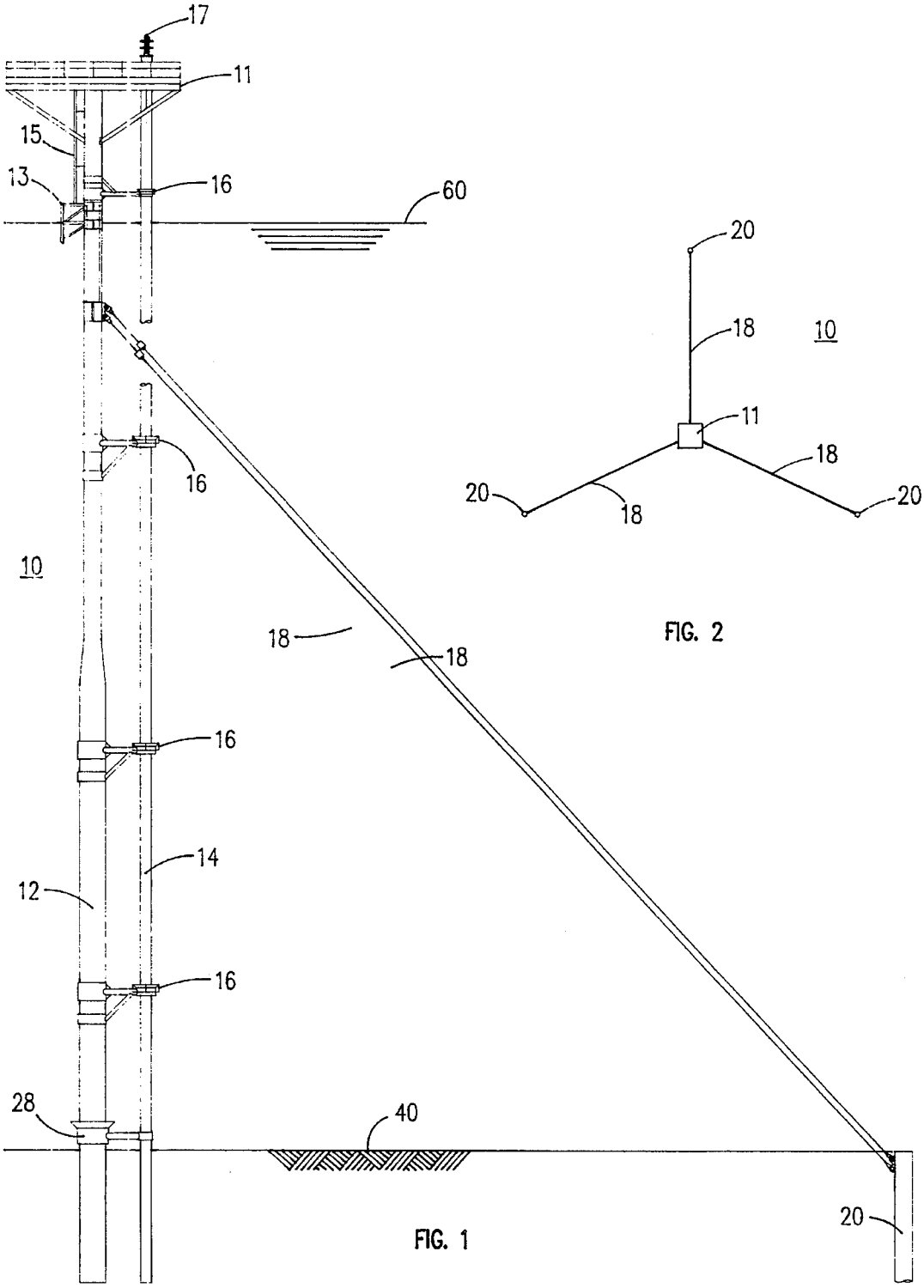
FIG. 1 is a side elevation view of the cable guyed caisson and conductor pipe support apparatus of the present invention.
FIG. 2 is a top view of the cable guyed caisson and conductor pipe support apparatus of the present invention.

Referring now to the drawings and more particularly to FIG. 1 there is shown a side-elevation view of the cable guyed caisson and conductor pipe support apparatus, generally designated 10. The apparatus 10 is comprised principally of a vertical caisson 12 driven into the mudline 40 below the surface 60 of a body of water adjacent to a conductor pipe 14. The caisson 12 is supported laterally by a plurality of cables 18 attached to anchor piles 20. The conductor pipe 14 is support laterally from the caisson 12 by means of conductor pipe braces 16 attached to the caisson 12.

As shown in FIG. 1, The caisson 12 may also be utilized to support a wellhead platform or deck 11 above the water surface 60 as well as a boat landing 13 and ladders 15. The platform 11, boat landing 13 and ladders 15 provide access to a wellhead 17 attached to a production pipe string, not shown, which runs down through the center of the conductor pipe 14. Additional conductor pipes 14 may be supported from the caisson 12 by means of the conductor braces 16 mounted to the caisson 12 for drilling multiple wells from a single caisson installation.

FIG. 2 shows a top view of the cable guyed caisson and conductor pipe support apparatus 10. The platform 11 is sized to allow sufficient room for maintenance equipment and for access to the wellhead 17. The anchor piles 20 are shown uniformly spaced around the caisson 12 and are attached to the caisson 12 by cables 18. A minimum of three anchor piles 20 with cables 18 spaced at equal angles around the caisson 12 are required to provide support for the lateral loads which might be encountered. Typically two cables 18 are attached to each anchor pile to provide caisson support. Multiple combinations of three cables 18 may be placed at various points along the caisson 12 as needed for support. Successful installations of such cable guyed structures have been installed in waters in excess of 250 feet though, theoretically, there is no limit to the depth in which a cable guyed caisson and conductor pipe support apparatus 10 may be utilized.

The cable guyed caisson and conductor pipe support apparatus 10 is not installed at the well location until it is determined that the drilling has produced sufficient hydrocarbons to warrant the installation of a permanent structure to support equipment and facilities for production and further exploration. Because the apparatus 10 is not installed until it is determined that sufficient hydrocarbons are present, the initial drilling and testing can be accomplished without the expense of installing a permanent support structure. Further, the drilling rig remains in its place to support the conductor pipe 14 until the apparatus 10 is installed and the conductor pipe 14 is fully supported. This allows the use of only a nominally sized conductor pipe 14, that is one sized only to accommodate the requirements to drill the well, rather than a conductor pipe 14 of sufficient structural integrity to support platforms, ladders and wellheads.

Figure 3:
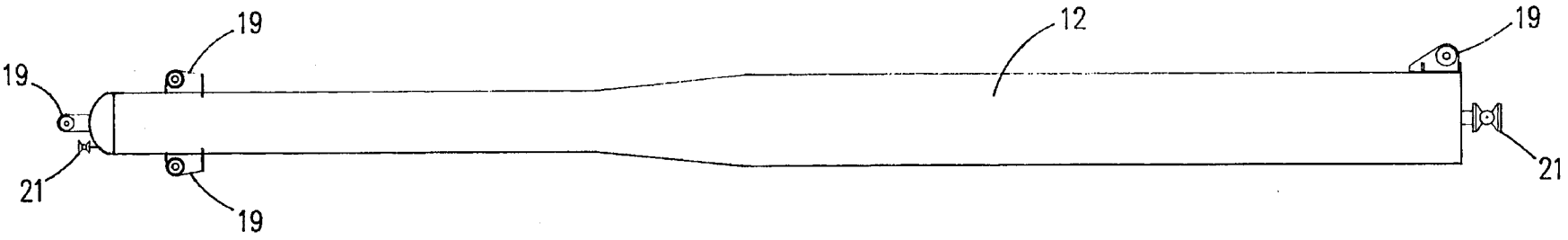
FIG. 3 is a side view of a typical caisson prior to installation.

A typical caisson 12 for use in the apparatus 10 is shown without cables, platforms and other appurtenant structures in FIG. 3. The caisson 12 is fabricated from structural steel with an overall diameter and length that varies in size depending upon the structural design requirements necessary to accommodate the environmental conditions and situations where it is to be installed. The caisson 12 is fabricated onshore as a tapered hollow tube with sealed top and bottom ends and is often in excess of 350 feet in length and 6 feet in diameter.

The caisson 12 is designed to be buoyant and to float horizontally so that it may be towed to an offshore location for installation. Padeyes 19 are attached to the outer surface of the caisson 12 for attachment of towing, steering and lifting lines. Valves 21 are located at each end of the caisson 12 so that the caisson 12 may be flooded to provide ballast during towing and to position the caisson 12 vertically at the well location at the time of installation.

Figure 4:
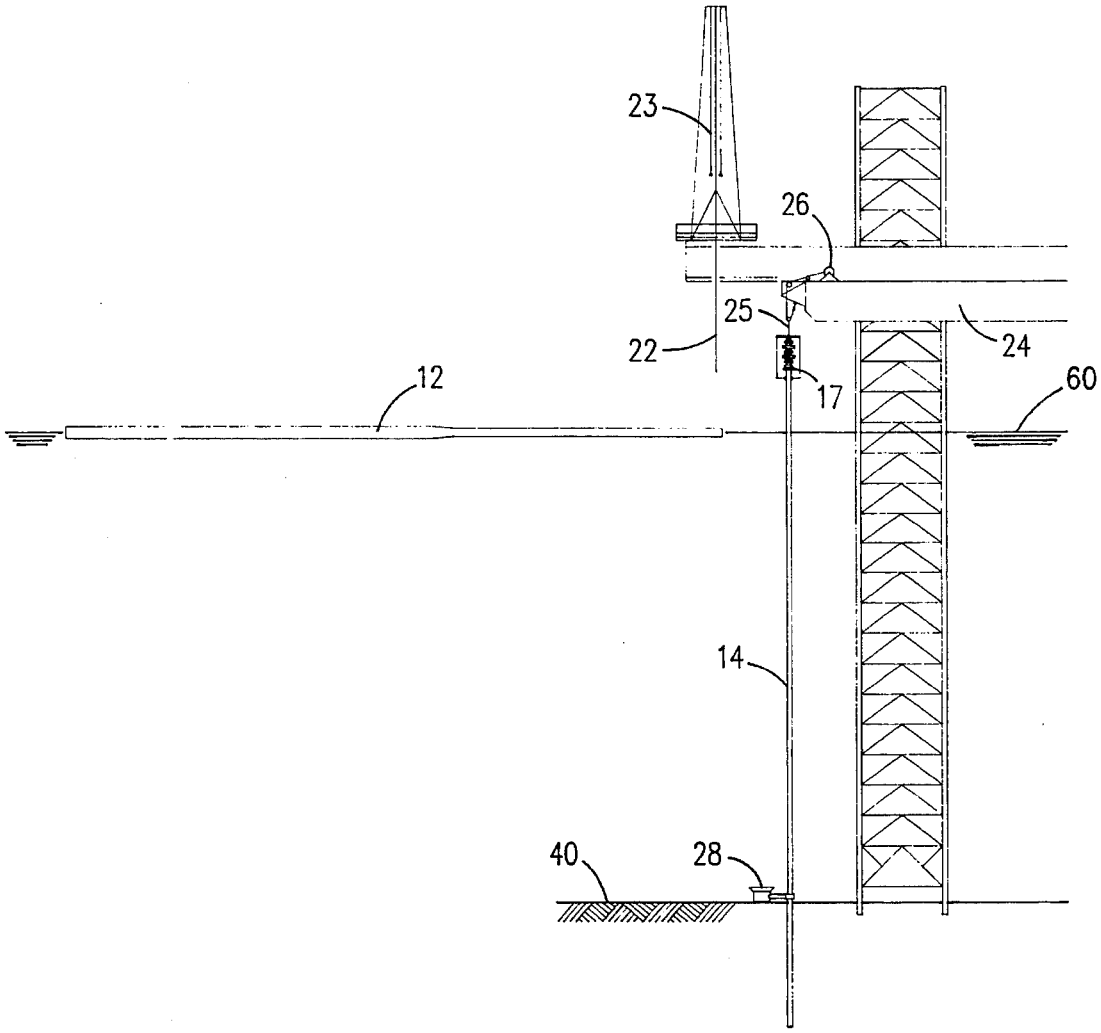
FIGS. 4, 5 and 6 are schematic views of the caisson installation procedure.
Figure 5:
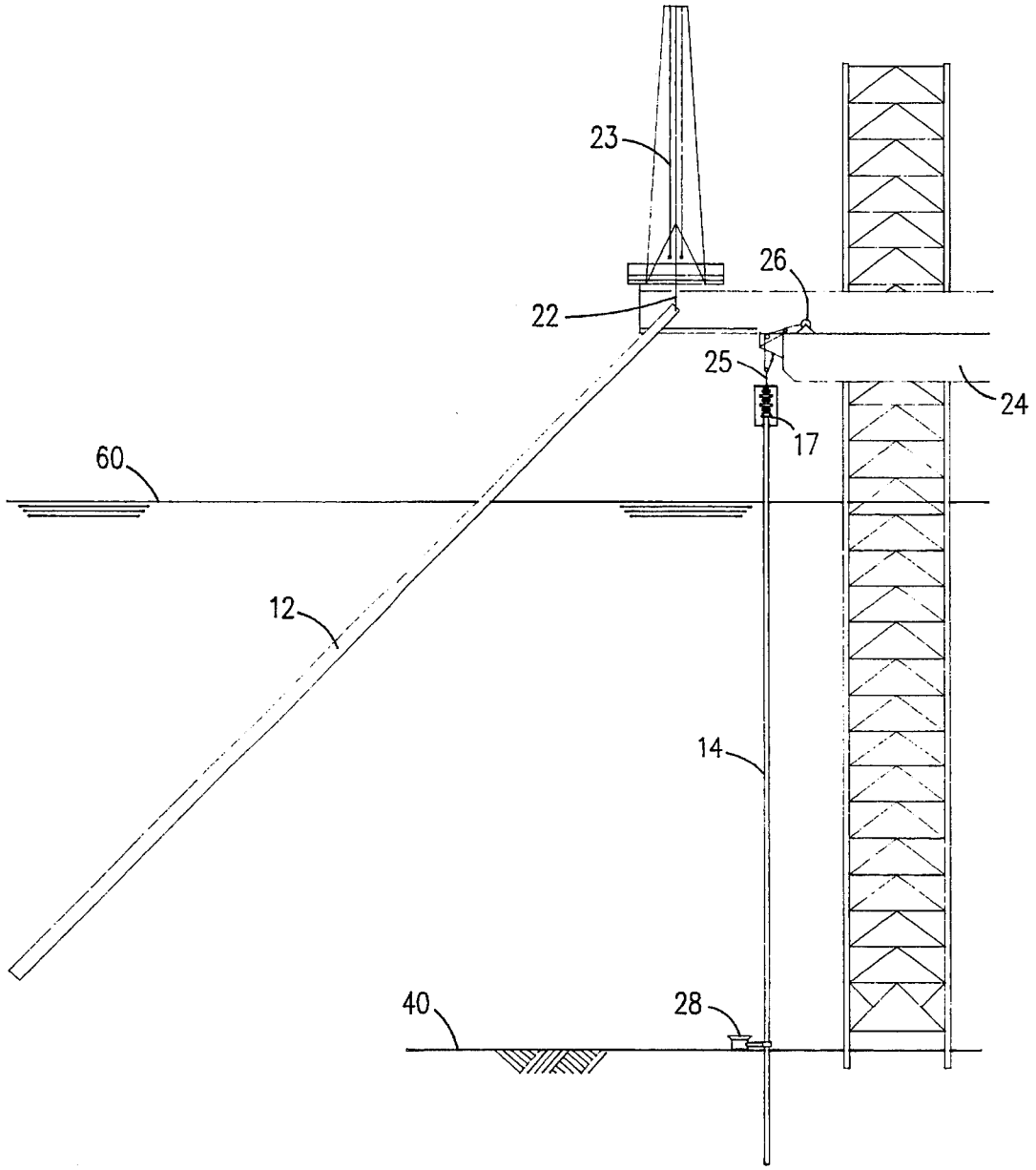
Figure 6:
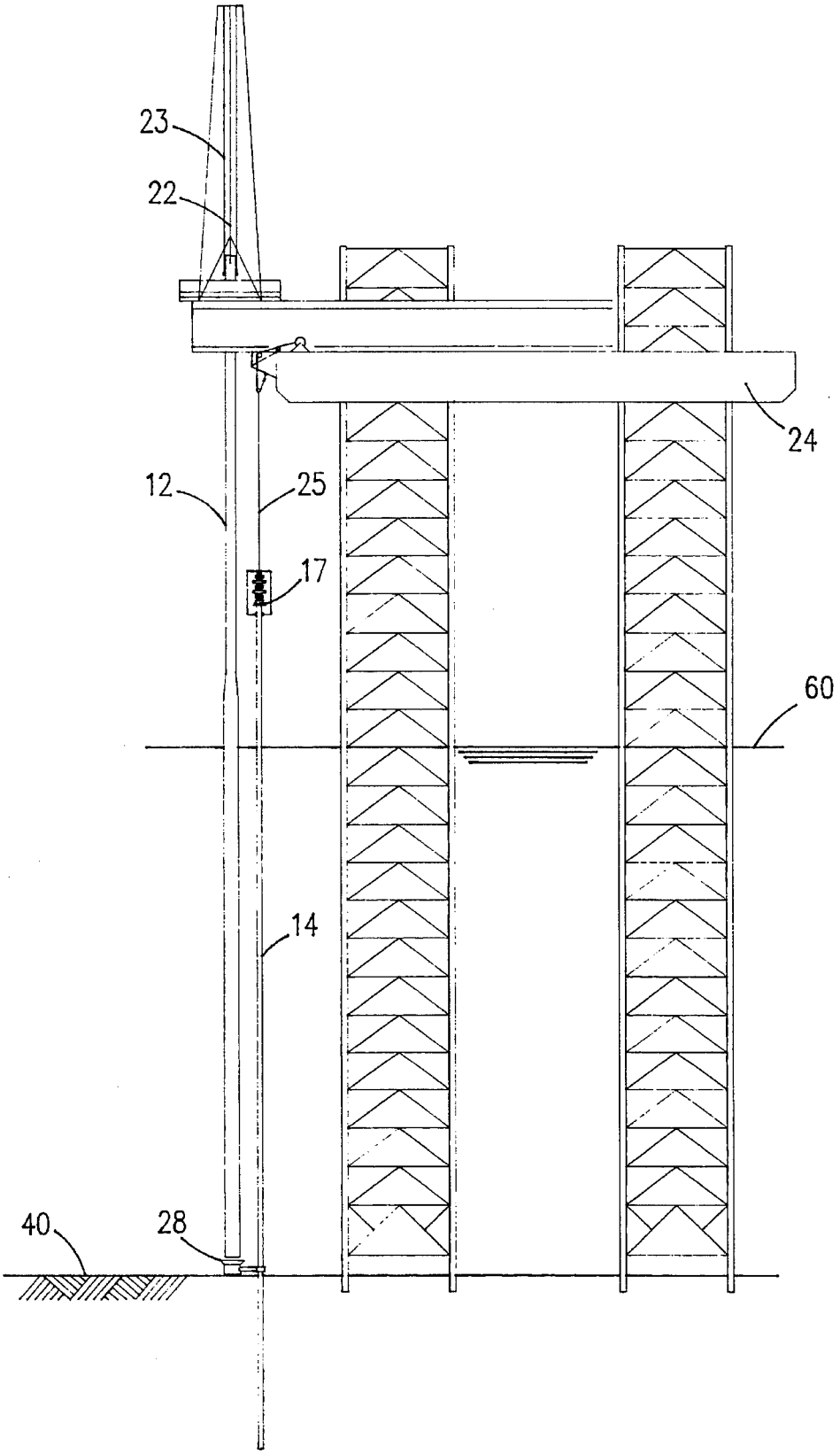

When it is determined that a permanent support structure is required at the well location, the caisson 12 is towed to the well location to begin the installation of the apparatus 10. The caisson installation procedure is illustrated in FIGS. 4 through 6. The caisson 12 is towed to well location with a towing vessel or vessels and attached to the draw works cable 22 from the draw works 23 located on the drilling rig 24. The valves 21 at the bottom end of the caisson 12 are opened to flood the hollow interior of the caisson 12 to tip it vertically so that it may be positioned vertically adjacent to the conductor pipe 14 in the caisson template 28 attached to the conductor pipe 14. When the caisson 12 is in the desired position, it is then driven by a hammer means into the mudline 40 to a predetermined desired depth. Preferably, the caisson 12 is driven by a hammer or other driving means operated from the draw works 23 located on the drilling rig 24.

Figure 7:
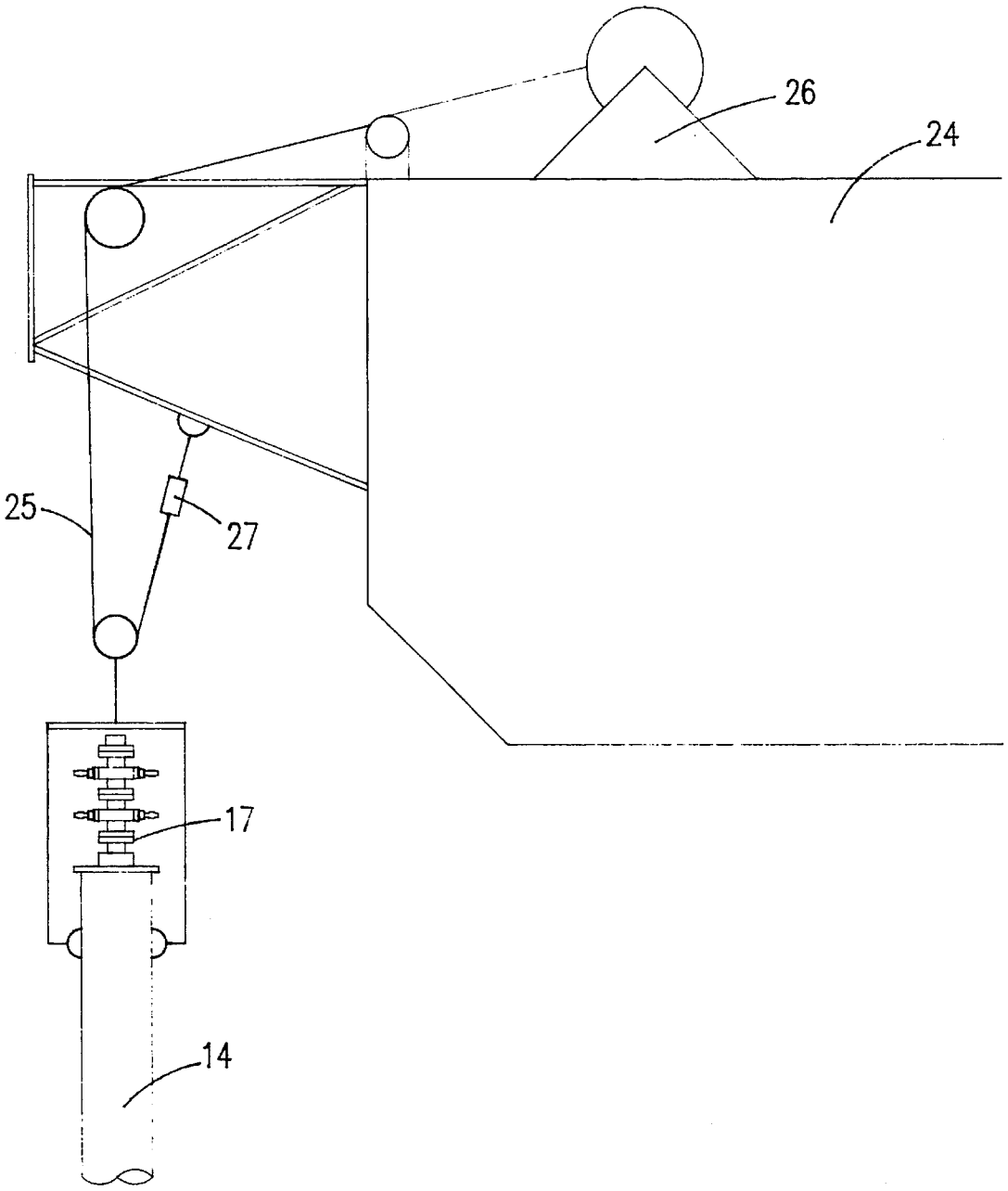
FIG. 7 is a side view of the conductor pipe tensioning means.

During the time period prior to the installation of the apparatus 10, the conductor pipe 14, previously driven into the mudline 40, is held in tension from the drilling rig 24. By holding the conductor pipe 14 in tension, the nominally sized conductor pipe 14 is given sufficient support to resist the lateral forces applied to the conductor pipe 14 from the wind and the waves. The conductor pipe tension force necessary to resist these lateral loads may be predetermined and is a function of the conductor pipe size and the anticipated lateral forces. One way to support the conductor pipe 14 in tension is illustrated in FIG. 7. The conductor pipe 14, shown with the wellhead 17 in place, is attached to a conductor pipe tension cable 25 held in the desired degree of tension by a winch 26 mounted on the drilling rig 24. A load cell 27 is attached to the tension cable 25 to monitor the load applied to the tension cable 25 so that the desired degree of tension on the conductor pipe 14 is maintained.

Figure 8:
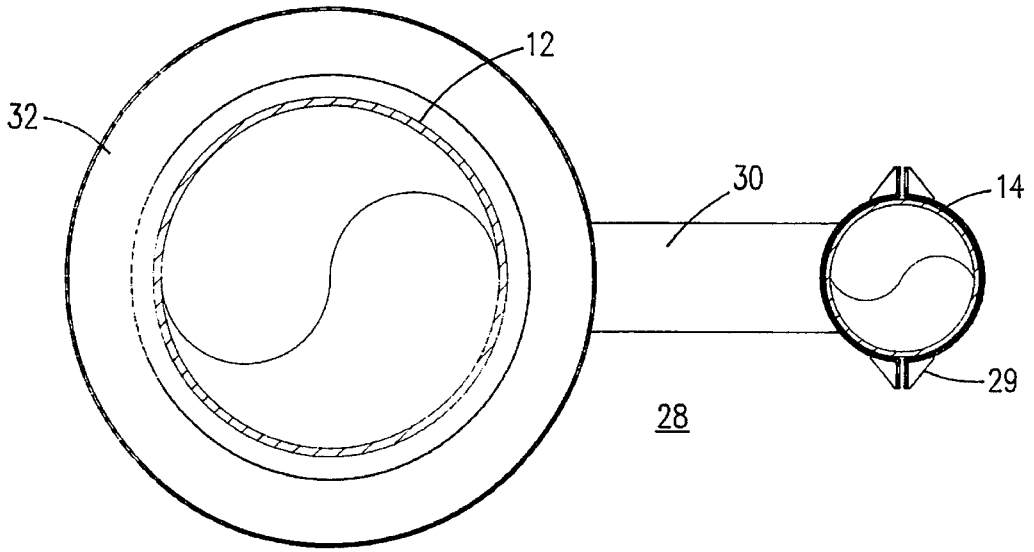
FIG. 8 is a top view of the caisson installation template.
Figure 9:
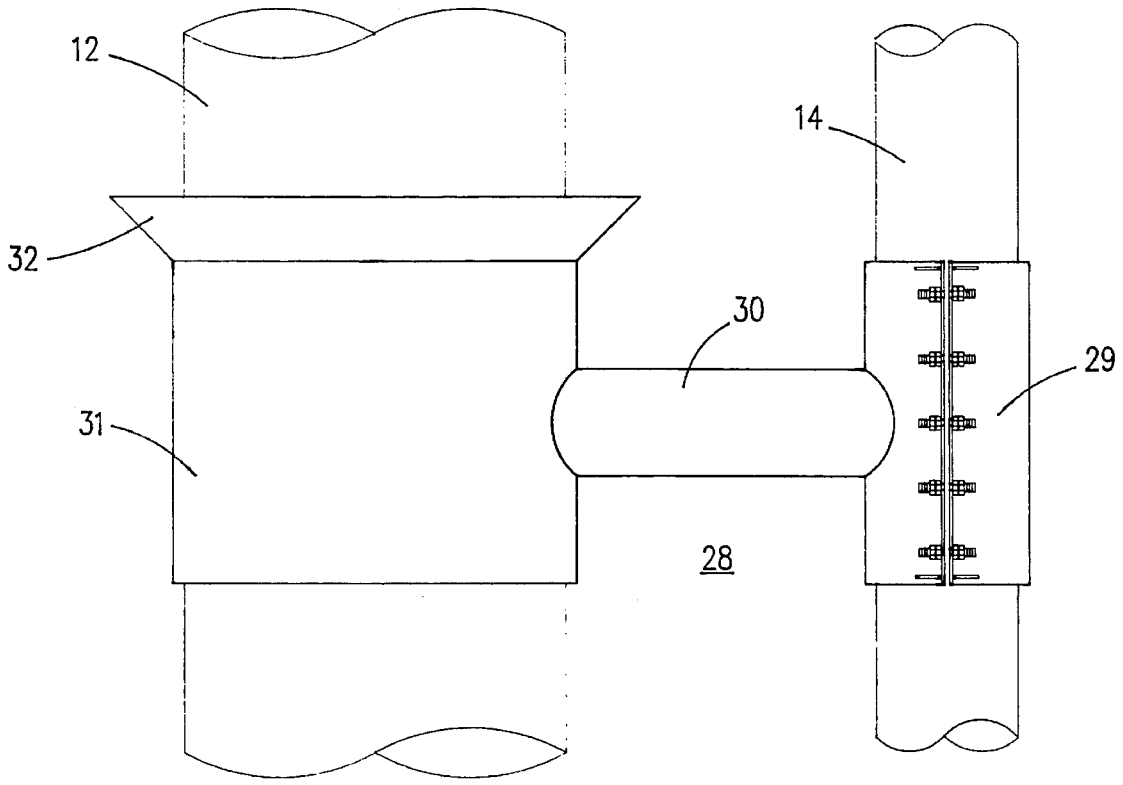
FIG. 9 is a side view of the caisson installation template.

The caisson 12 is positioned at the proper location adjacent to the conductor pipe 14 by means of a caisson template 28 attached to the conductor pipe 14. The caisson template 28, shown from the top in FIG. 8 and from the side in FIG. 9, is comprised of a circular conductor pipe clamp 29, a positioning arm 30 of sufficient length to establish the desired distance between the centerline of the conductor pipe 14 and the centerline of the caisson 12, and caisson guide 31 of sufficient diameter to accommodate the diameter of the caisson 12. The conductor pipe clamp 29 of the caisson template 28 is securely bolted by divers to the conductor pipe 14 in the desired position on the mudline 40 below the water surface 60. The caisson guide 31 has a belled lip 32 to serve as a funnel for guiding the bottom end of the caisson 12 into the caisson guide 31 when the caisson 12 is flooded and positioned vertically along side the conductor pipe 14. This is done with the assistance of divers positioned at or near the mudline.

Figure 10:
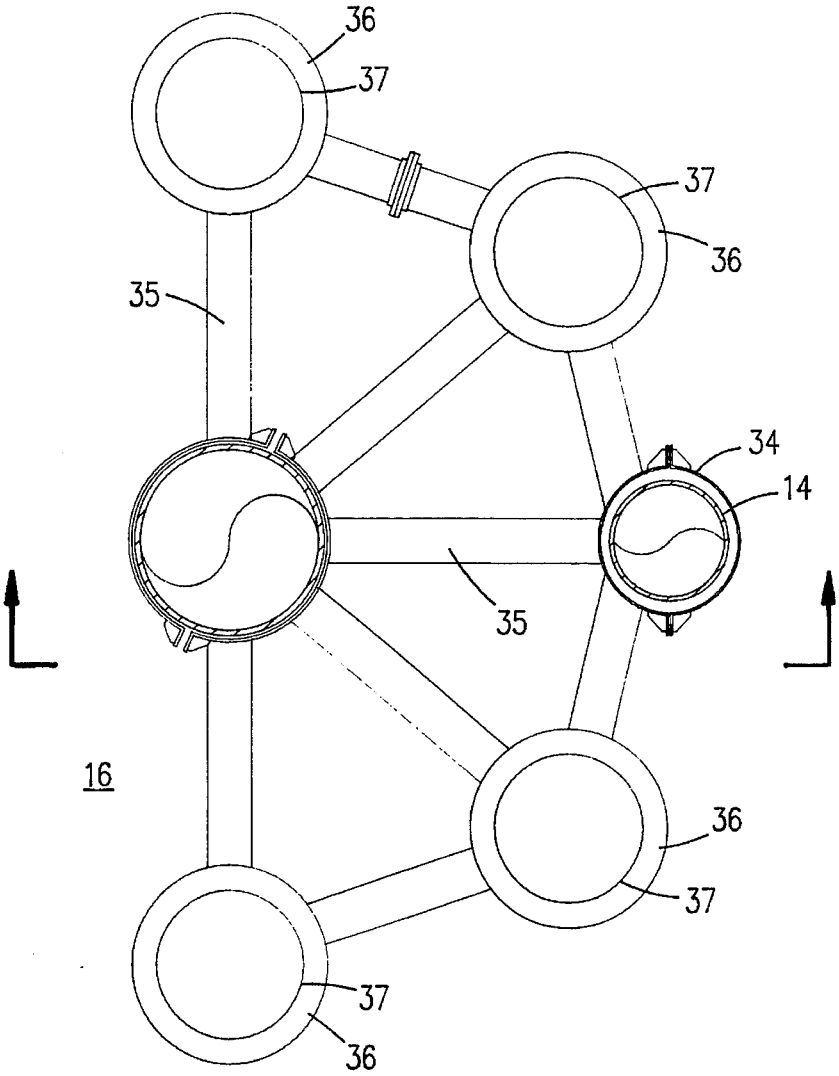
FIG. 10 is a top view of the conductor pipe brace with conductor guides.
Figure 11:
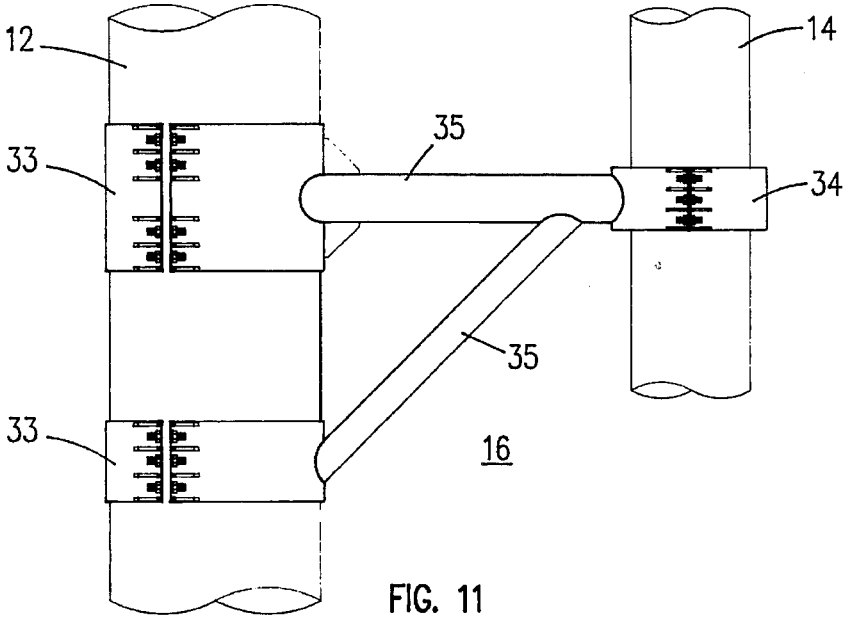
FIG. 11 is a side view of the conductor pipe brace of FIG. 10.

After the caisson 12 is driven to the desired depth, divers are utilized to install the conductor pipe braces 16 between the conductor pipe 14 and the caisson 12 to provide lateral support the conductor pipe 14. A series of conductor pipe braces 16, shown from the top in FIG. 10 and from the side in FIG. 11, are mounted along the length of the caisson 12. Each conductor pipe brace 16 preferably has a pair of two piece circular caisson clamps 33 for attaching the brace 16 to the caisson 12 and a two piece conductor pipe support ring 34 to provide lateral to support the conductor pipe 14. The conductor pipe support ring 34 is bolted around but not clamped or attached to the conductor pipe 14. The support ring 34 provides lateral support to the conductor pipe 14 and limits lateral deflection of the conductor pipe 14. Struts 35 of a predetermined length are utilized to provide lateral support for the conductor pipe 14 at a predetermined distance from the caisson 12. A plurality of conductor guides 36 may be incorporated into the conductor pipe brace 16 and supported by additional struts 35 of a predetermined length to accommodate installation of additional well conductor pipes at a predetermined distance from the caisson 12 so that multiple wells may be drilled and operated from the same structure. Preferably the conductor guides 36 have a funnel or bell shaped upper edge 37 similar to the bellied lip 32 of the caisson guide 31 to facilitate positioning an additional conductor pipe down through the conductor guides 36. When conductor guides 36 are incorporated into the brace 16, horizontal struts 35A are used to tie the guides 36 together. Preferably at least one of the horizontal struts 35A is fabricated in a two piece segment and bolted together at flange 35B to facilitate installation of the brace 16 around the caisson 12.

Figure 12:
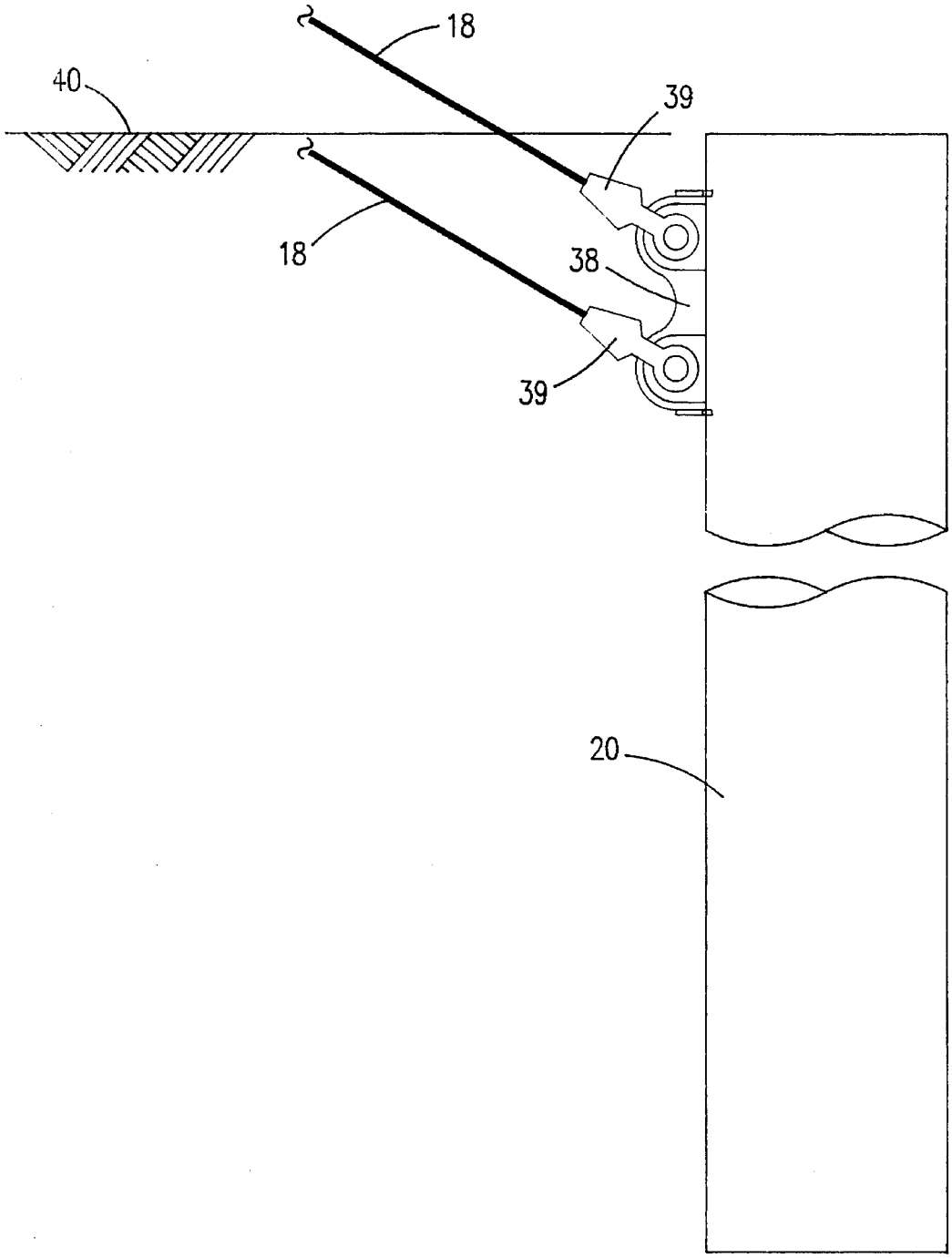
FIG. 12 is a partial side elevation view of the anchor pile showing the pile padeye plate and cable clamp.

Once the caisson 12 is installed adjacent to the conductor pipe 14, a plurality of at least three anchor piles 20 are driven to the mudline 40 around the caisson 12 to serve as anchors for a plurality of lateral support cables 18. Pairs of cables 18 are attached to each anchor pile 20 by means of an anchor pile padeye plate 38 mounted to the anchor pile 20 and a socket 39 attached to the cable 18 as shown in detail in FIG. 12. The diameter and length of the anchor piles 20 may vary depending upon the soils found at the well location though a typical anchor pile 20 may be over one hundred feet in length and four feet in diameter. At least three anchor piles 20 are positioned uniformly around the periphery of the caisson 12 as required to provide lateral support for the caisson as shown in FIG. 2.

Figure 13:
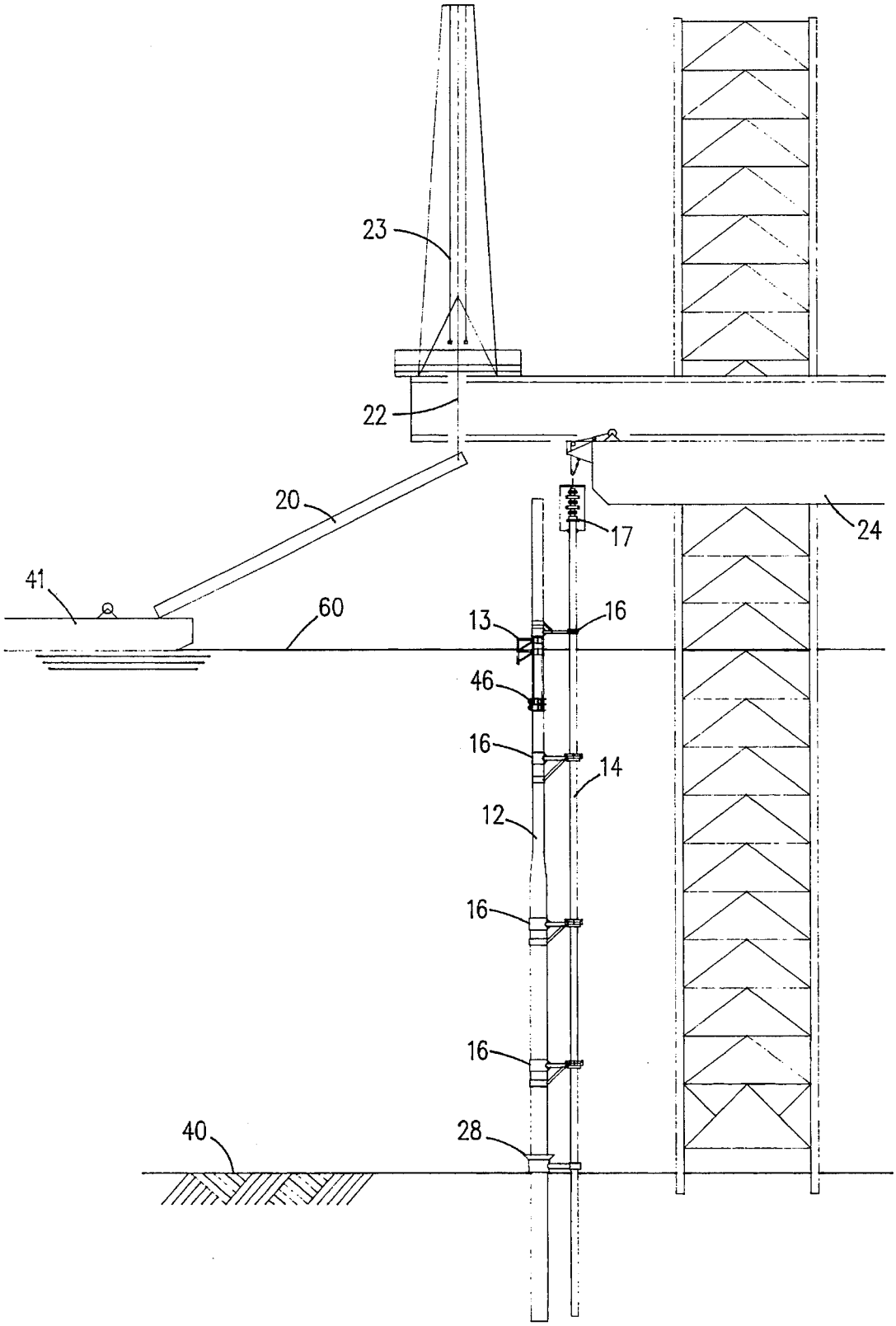
FIGS. 13 through 16 are schematic views of the anchor pile installation procedure.
Figure 14:
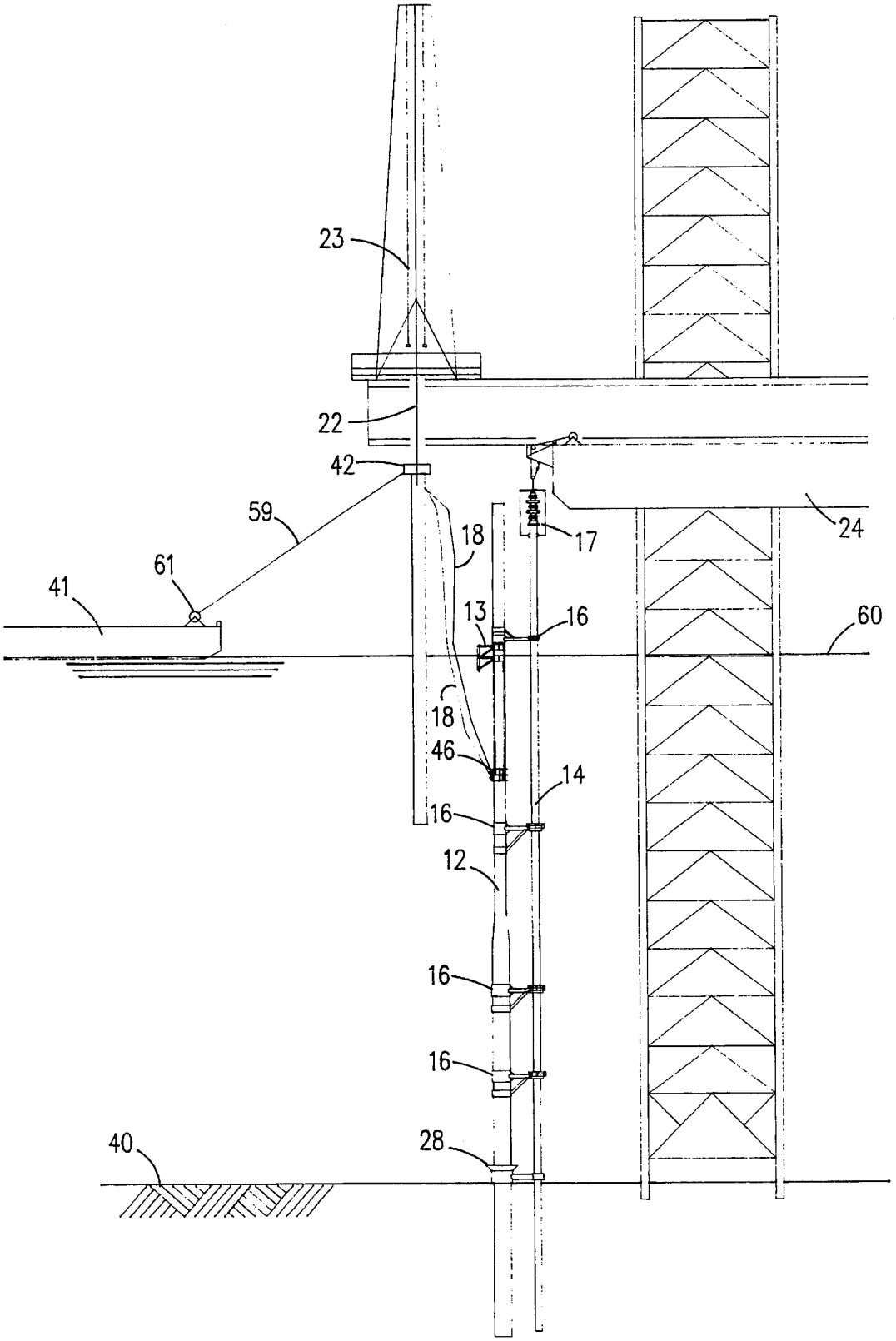
Figure 15:
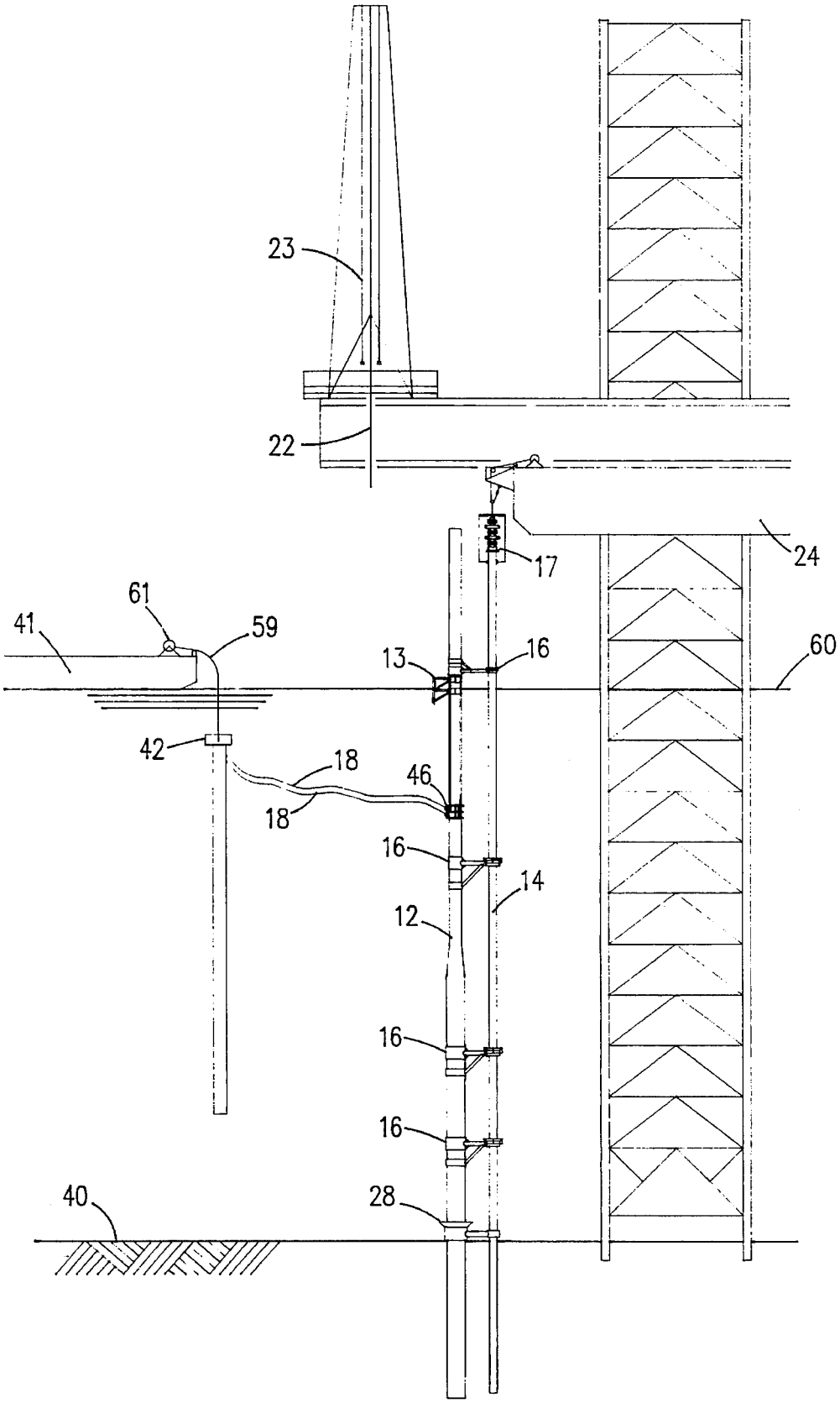
Figure 16:
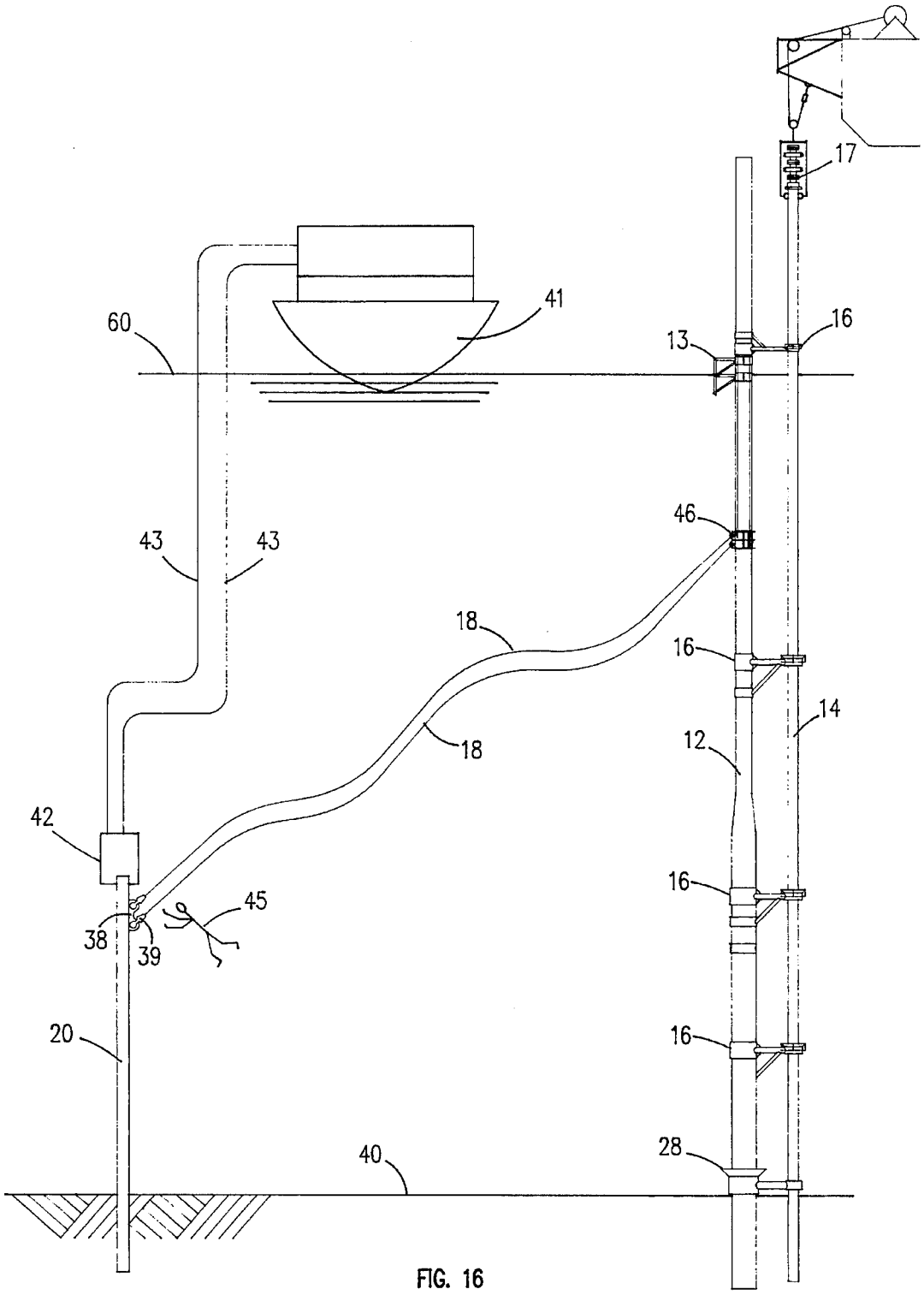

The anchor pile installation procedure is illustrated in FIGS. 13 through 16. In FIG. 13, dive boat 41 or another service vessel is used to carry the anchor piles 20 to the well location. The cable 22 from the draw works 23 on the drilling rig 24 is used to lift the anchor piles 20 from the dive boat 41. In FIG. 14, the cables 18 are attached to the caisson 12 and the anchor pile 20 along with the subsurface hammer 42 and the service cable 59 from a dive boat winch 61. As the draw works 23 lowers the cable 22 the winch 61 draws in cable 59 and Cable 22 is then released from the anchor pile 20. The dive boat 41 moves the anchor piles 20 to the proper position around the caisson 12 and lowers it to a predetermined position on the mudline 40. Once positioned as shown in FIG. 16, the anchor piles 20 are driven at the mudline 40 into the water bottom by means of a subsurface remotely controlled hammer 42 operated from the dive boat 41 located at the surface 60 by means of hammer control lines 43 as shown schematically in FIG. 16. A vibratory hammer of the type manufactured by International Construction Equipment, Inc. is thought to be sufficient for a typical anchor pile installation, though other subsurface remotely operated hammers such as hydraulic hammers may be utilized. Divers 45 are in the water to assist and direct the installation of the anchor piles 20. Installation of the anchor piles 20 in this fashion eliminates the need for using long drive piles positioned and driven by means of a crane and surface hammer located on a derrick barge or other such vessel. The subsurface hammer 42 can be operated and controlled from a much smaller and less costly dive boat.

The cables 18 may be steel or any other suitable material. However, in the preferred embodiment, cables with "KEVLAR" components such as "PHILLYSTRAN" cables manufactured by United Rope Works are used. The "PHILLYSTRAN" cables are easier to manipulate and have superior tensile strength and less long term creep than steel cables. The cables 18 are attached to the caisson 12 and tightened to the desired tension by means of a tension block assembly 44 located at a predetermined depth below the water surface 60. Divers 45 are utilized to tension the cables 18 by means of the tension block assembly 44.

Figure 17:
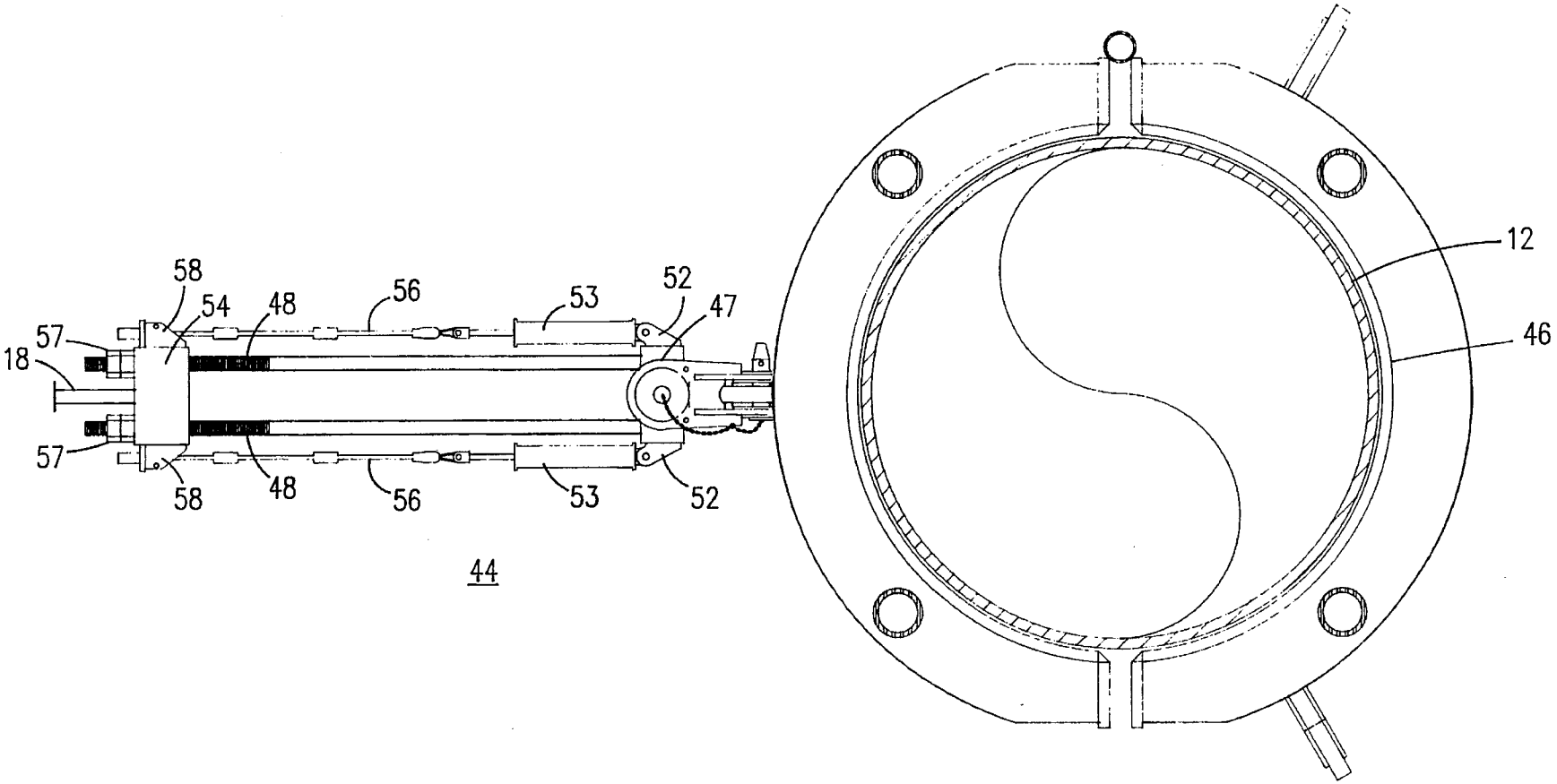
FIG. 17 is a top view of the cable tension block assembly with the hydraulic jacks in place.
Figure 18:
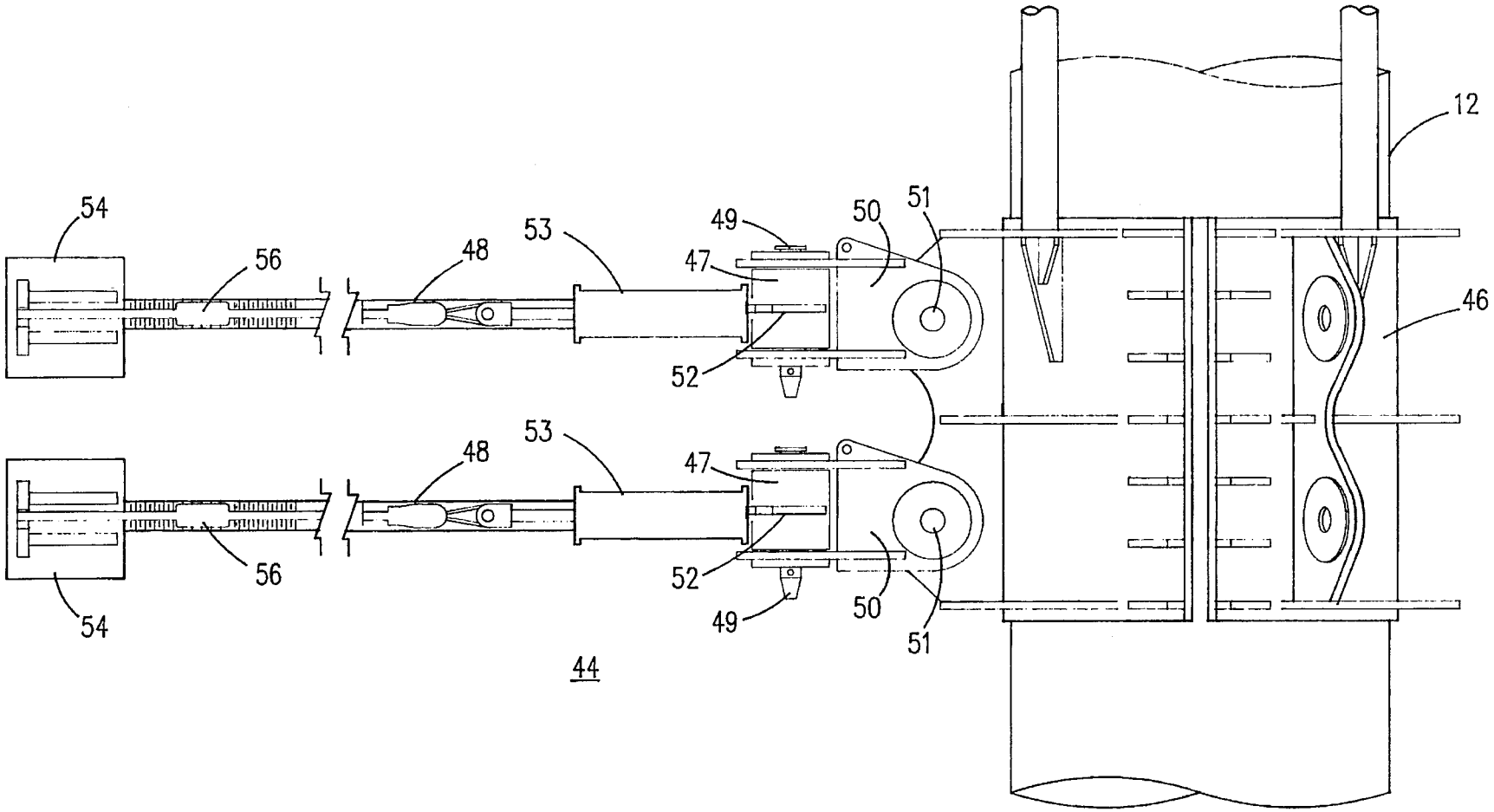
FIG. 18 is a partial side elevation view of the cable tension block assembly.

The tension block assembly 44, shown from the top in FIG. 17 and from the side in FIG. 18, is comprised of a termination clamp 46 securely mounted to the caisson 12 in a pre-determined positioned by divers using bolts or other means. A tension rod Block 47, drilled and threaded for screwably receiving one end of a pair of threaded tension rods 48, is pinned by pins 49 to padeye 50 which is pinned to the termination clamp 46 by pinning means 51 to allow two directional movement or pivot of the tension rod Block 47. The tension rod Block 47 also has jack padeyes 52 for attaching hydraulic jacks 53. A cable terminator Block 54 is slidably attached to the threaded tension rods 48 at the ends opposite the tension rod Block 47. The cable terminator Block 54 has a bore to receive a cable terminal piece, not shown, mounted to the cable 18. Tension cables 56 are mounted to tension cable clips 58 between the hydraulic jacks 53 and the cable terminator socket 54 along the sides of the tension rods 48 by means of cable tension clips 58.

Divers, operating below the water surface 60, install the hydraulic jacks 53 and tension cables 56 between the tension rod block 47 and the cable terminator block 54. Then the hydraulic jacks 53, operated and monitored from the surface, all engaged to place tension on the tension cables 56 and to pull the cable terminator block 54 along the threaded tension rods 48. The cable terminator block 54 is then held in that position on the tension rods 48 by means of double nuts and washers 57 threaded onto the end of each tension rod 48 and tightened by the divers. The process is then repeated until the cable terminator block 54 is moved along the tension rods 48 an amount sufficient to put the desired degree of tension in the cables 18.

Figure 19:
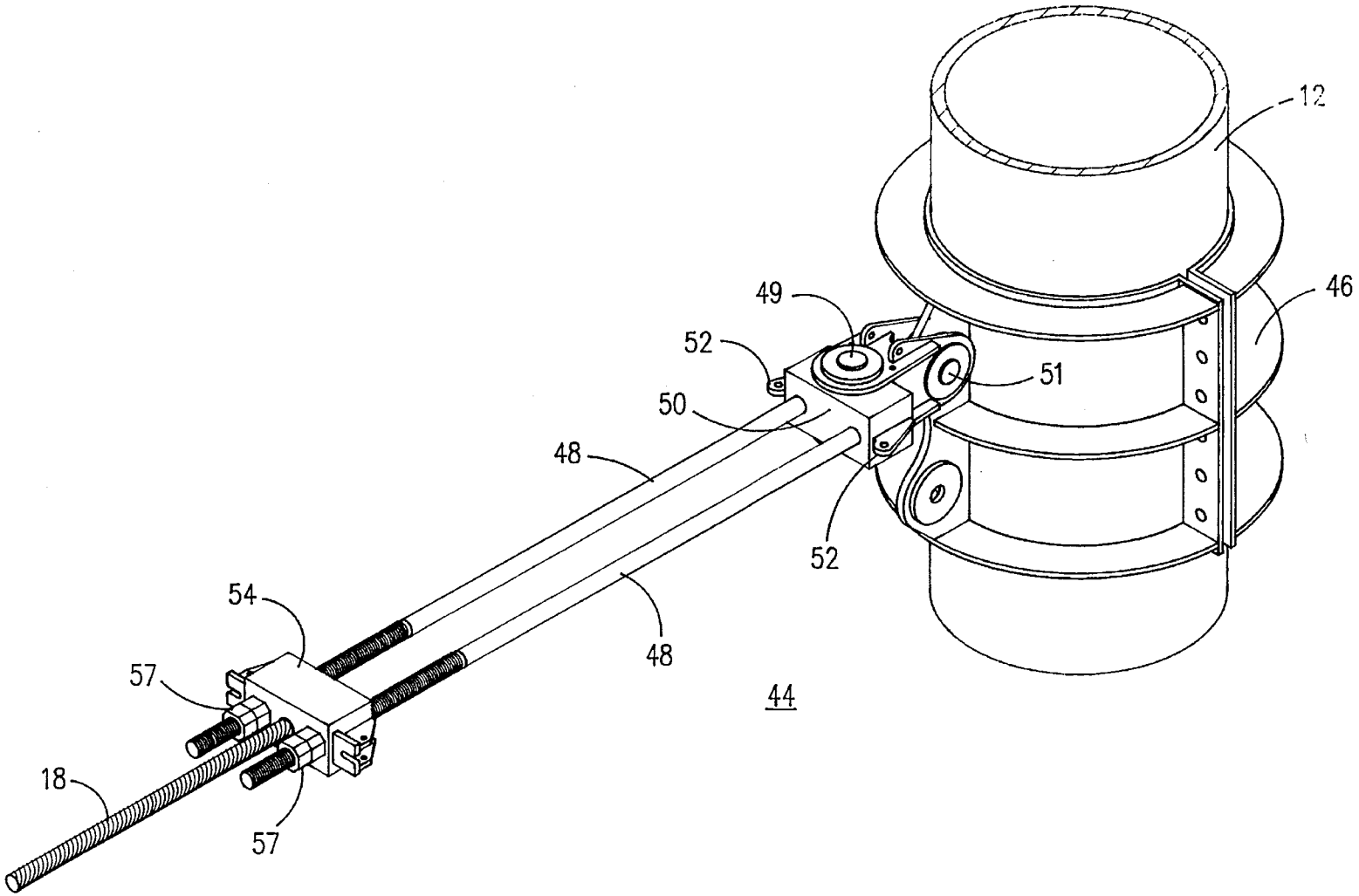
FIG. 19 is a perspective view of the cable tension block assembly with the cable tensioned and the hydraulic cylinder removed.

FIG. 19 shows a perspective view of the tension block assembly 44 in place on the caisson 12 at the conclusion of the procedure used to tension anchor cables 18. A single cable 18 is shown for clarity through multiple cables 18 are typically used. The hydraulic jacks 53 and the tension cables 56 are removed by divers from the tension block assembly 44 when the cables 18 have been installed and sufficiently tensioned.

After the cables 18 are in place and tensioned, the cable guyed caisson and conductor support apparatus 10 of FIG. 1 is essentially completed. The wellhead deck 11, the boat landing 13 and ladders 15 may then be installed on the caisson 12. The tension on the conductor pipe 14 that has been maintained by the winch 26 may be released and the drilling rig 24 may be removed from the well location.

It is thought that the cable guyed caisson and conductor pipe support apparatus and method of the present invention and many of its attendant advantages will be understood from the foregoing description and it will be apparent that various changes may be made in the form, construction and arrangement of the parts thereof without departing from the spirit and scope of the invention or sacrificing all of its material advantages, the form described herein being merely a preferred or exemplary embodiment of the invention.

I claim:

1. An apparatus for supporting an offshore well located at a desired location in a depth of water above a water bottom that has been installed by a moveable drilling rig, after said drilling rig has been removed from said well location, said well having a conductor pipe, access platforms, a wellhead and wellhead equipment, where said movable drilling rig is used to drive said conductor pipe into the mudline of said water bottom and temporarily support said conductor pipe while said offshore well is drilled and completed with a wellhead, through said conductor pipe, comprising:

(a) means for holding said conductor pipe in tension from said drilling rig;

(b) a caisson driven into said mudline adjacent to said conductor pipe;

(c) a plurality of at least three anchor piles driven into said mudline around said caisson;

(d) a plurality of anchor cables, each of said cables having first and second ends;

(e) means for attaching said first end of said anchor cables to said anchor piles;

(f) means for attaching said second end of said cables to said caisson;

(g) means for tightening said cables to a desired degree of tension;

(h) a plurality of conductor braces mounted to said caisson between said caisson and said conductor pipe for supporting said conductor pipe at intervals along its length above said mudline; and (i) wellhead access means mounted to said caisson for access to said wellhead.

2. An offshore well support apparatus as recited in claim 1, further comprising means to position said caisson adjacent to said conductor.

3. An offshore well support apparatus as recited in claim 2, wherein said means to position said caisson adjacent to said conductor includes a template mounted to said conductor pipe above said water bottom mudline for locating said caisson in the desired position adjacent to said conductor pipe, said template comprised of a clamp for mounting said template to said conductor for pipe, a spacer pipe, and a caisson guide ring having a bell shaped upper rim.

4. An offshore well support structure as recited in claim 2 wherein said means for tightening said anchor cables to the desired degree of tension includes:

(a) a termination clamp mounted to said caisson;

(b) a padeye pivotally mounted to said clamp;

(c) a plurality of threaded rods, said rods having first and second ends;

(d) a tension rod block pivotally mounted to said padeye, said tension block being bored to receive said plurality of said threaded rods;

(e) an anchor cable block mounted to said second end of said anchor cable, said anchor cable block having a bore to receive and retain said second end of at least one of said anchor cables, said anchor cable block being slidably positionable along said threaded rods;

(f) a plurality of hydraulic rams attached to said tension rod block;

(g) a plurality of tension cables, wherein at least one of said cables is attached at one end to one of said hydraulic rams and at the other end to said anchor cable block;

(h) means for engaging said ram whereby said anchor cable block is pulled along said tension rods by said tension cables toward said tension rod block; and (i) means for holding said anchor cable block in position on said tension rod.

5. An offshore well support apparatus as recited in claim 1, wherein said conductor braces include a plurality of conductor pipe guides for supporting additional well conductor pipe.

6. An offshore well support apparatus as recited in claim 5, wherein said conductor pipe guide includes a circular guide ring, said guide ring having a bell shaped upper rim for receiving said conductor pipe.

7. An offshore well support apparatus as recited in claim 2, wherein said means for holding said conductor pipe in tension includes means for measuring and regulating the tension pull on said conductor pipe.

8. An offshore well support apparatus as recited in claim 7, wherein said means for measuring and regulating the tension pull on said conductor pipe, includes:

(a) a winch mounted on said drilling rig, (b) a winch cable attached to said winch and to said conductor pipe, (c) a hydraulic cylinder attached to said winch cable for measuring the tension pull on said winch cable, and (d) means for adjusting the pull of said winch.

9. An offshore well support apparatus as recited in claim 8, wherein said wellhead access means includes, a boat landing, ladders and a platform.

10. An offshore well support apparatus as recited in claim 1, wherein each of said conductor pipe braces includes a two piece circular brace clamp for mounting said conductor brace to said caisson, a two piece conductor pipe support ring, a conductor pipe support strut having a predetermined length and first and second ends, said conductor pipe support strut being mounted to said brace clamp at said first end and said support ring at said second end so as to position said support ring at a predetermined position radially from said caisson, a plurality of conductor guide rings for receiving an additional conductor pipe, a plurality of conductor guide struts, each of said guide struts being mounted to said brace clamp and said guide rings so as to position said guide rings adjacent to each other at predetermined positions radially from said caisson, and a plurality of horizontal ring braces for supporting said adjacent guide rings, said guide rings having a bell shaped upper rim for receiving said additional conductor pipe.

11. An apparatus for supporting a conductor pipe, a plurality of access platforms, a wellhead and a plurality of wellhead equipment of an offshore well located in a desired location in a depth of water above a water bottom after a movable drilling rig has been removed from said location, where said movable drilling rig is used to drive said conductor pipe into the mudline of said water bottom and temporarily support said conductor pipe while said offshore well is drilled and completed with a wellhead, through said conductor pipe, comprising:

(a) means for holding said conductor pipe in tension from said drilling rig;

(b) a caisson driven into said mudline adjacent to said conductor pipe;

(c) a plurality of at least three anchor piles driven into said mudline around said caisson;

(d) a plurality of anchor cables, each of said cables having first and second ends;

(e) means for attaching said first end of said anchor cables to said anchor piles;

(f) means for attaching said second end of said cables to said caisson;

(g) means for tightening said cables to a desired degree of tension comprising a clamp mounted to said caisson, a padeye pivotally mounted to said clamp, a plurality of threaded rods, said rods having first and second ends, a tension rod block pivotally mounted to said clamp, said tension rod block being bored to receive said plurality of threaded rods, an anchor cable block mounted to said second end of said anchor cable, said anchor cable block having a bore to receive and retain said second end of at least one of said anchor cables, said anchor cable being slidably positionable along said threaded rods, a plurality of hydraulic rams attached to said tension rod block, a plurality of tension cables, said cables being attached at one end to said hydraulic rams and at the other end to said anchor cable block, means for engaging said ram whereby said anchor cable block is pulled along said tension rods by said tension cables toward said tension rod block, and means for holding said anchor cable block in position on said tension rod;

(h) a plurality of conductor braces mounted to said caisson, between said caisson and said conductor pipe, for supporting said conductor pipe at intervals along its length above said mudline, wherein each of said conductor pipe braces includes a two piece circular brace clamp for mounting said conductor brace to said caisson, a two piece conductor pipe support ring, a conductor pipe support strut having a predetermined length and first and second ends, said conductor pipe support strut being mounted to said brace clamp at said first end and said support ring at said second end so as to position said support ring at a predetermined position radially from said caisson around said conductor pipe, a plurality of conductor guide rings, said guide rings having a bell shaped upper rim for receiving an additional conductor pipe, a plurality of conductor guide struts, each of said guide struts being mounted to said brace clamp and said guide rings so as to position said guide rings adjacent to each other at predetermined positions radially from said caisson, a plurality of horizontal ring braces for supporting said adjacent guide rings, at least one of said horizontal ring braces being a two piece brace; and (i) wellhead access means mounted to said caisson for access to said wellhead, wherein said access means includes a boat landing, ladders and a platform.

12. An offshore well support apparatus as recited in claim 11, further comprising means to position said caisson adjacent to said conductor pipe, wherein said means to position said caisson adjacent to said conductor pipe includes a template mounted to said conductor pipe above said water bottom mudline for locating said caisson in the desired position adjacent to said conductor pipe, said template having a circular ring with a bell shaped upper lip for vertically receiving said caisson.

13. An offshore well support apparatus as recited in claim 12, wherein said means for holding said conductor pipe in tension includes means for measuring and regulating the tension pull on said conductor pipe.

14. A method for providing an offshore well structure for supporting a conductor pipe and providing access to a wellhead of an offshore well completed at an offshore well location with a movable drilling rig so that said drilling rig may be removed, comprising the steps of:

(a) holding said conductor pipe in tension from said drilling rig;

(b) providing a caisson to support said conductor pipe, said caisson having towing and lifting padeyes and valves for flooding said caisson;

(c) towing said caisson to said completed well;

(d) holding said caisson with a cable from said drilling rig;

(e) opening said valves to flood said caisson;

(f) positioning said caisson vertically adjacent to said conductor pipe;

(g) driving said caisson into said offshore water bottom from said drilling rig;

(h) attaching a plurality of conductor pipe support braces to said caisson at predetermined positions above and below the water surface along the length of said caisson so as to provide lateral support to said conductor pipe;

(i) providing a plurality of at least three anchor piling;

(j) providing a plurality of anchor cables, each of said cables having a first end and a second end;

(k) attaching an anchor cable tensioning means for each of said anchor cables to said caisson at a predetermined position below the water surface on said caisson;

(l) attaching said first end of one of said cables to the top of each of said anchor piling;

(m) attaching said second end of said anchor cables to said anchor cable tensioning means;

(n) driving said anchor piles at predetermined positions around said caisson;

(o) tightening said anchor cables to a predetermined tension with said anchor cable tensioning means;

(p) attaching a wellhead access system to said caisson;

(q) releasing said tension from said conductor pipe; and (r) removing said drilling rig from said well.

15. A method for providing an offshore well structure as recited in claim 14, wherein the step of holding said conductor pipe in tension from said drilling rig includes measuring and regulating the tension pull on said conductor pipe.

16. A method for providing an offshore well structure as recited in claim 15, wherein the step of positioning said caisson vertically adjacent to said conductor pipe includes the additional step of providing a template attached to said conductor pipe to receive and guide said caisson.

17. A method for providing an offshore well structure as recited in claim 15, wherein the step of driving said anchor piles at predetermined positions around said caisson includes using underwater hammers for driving said anchor piles.

18. A method for providing an offshore well structure as recited in claim 17, wherein said underwater hammers are vibratory hammers.

19. A method for providing an offshore well structure as recited in claim 17, wherein said underwater hammers are hydraulic hammers.

20. A method for providing an offshore well structure as recited in claim 17, wherein said step of tightening said anchor cables to a predetermined tension with said anchor cable tensioning means includes using divers.

21. A method for providing an offshore well structure as recited in claim 17, wherein said step of attaching a plurality of conductor pipe support braces to said caisson includes using divers to attach said braces below said water surface.

22. A method for providing an offshore well structure as recited in claim 17, wherein divers are utilized in completing all underwater steps.

23. A method for providing an offshore well structure as recited in claim 17, includes the additional step of providing a plurality of conductor pipe support guides to facilitate installation of additional well conductor pipe.

24. A method for providing an offshore well structure as recited in claim 17, wherein the step of attaching a wellhead access system includes attaching a boat landing, ladders and a platform to said caisson.

25. A method for providing an offshore well structure as recited in claim 23, wherein said conductor pipe support guides are incorporated with said conductor pipe braces.

26. A method for providing an offshore well structure as recited in claim 17, wherein said step of tightening said anchor cables to a predetermined tension with said anchor cable tensioning means includes mounting a clamp to said caisson; pivotally mounting a padeye to said clamp; pivotally mounting a tension rod block to said padeye; attaching a plurality of threaded rods to said tension rod block; attaching an anchor cable block to said anchor cable, said anchor cable block having a plurality of bores; inserting said threaded rods through said bores of said anchor cable block to slidably position said anchor cable block along said threaded rods; attaching a plurality of hydraulic rams to said tension rod block; providing a plurality of tensioning cables; attaching said tensioning cables between said hydraulic rams and said anchor cable block; engaging said hydraulic rams so as to pull said anchor cable block with said tensioning cables along said tension rods toward said tension rod block; and providing means for holding said anchor cable block in position on said tension rod.

* * * * *